US007378595B2

(12) United States Patent
Brambilla

(10) Patent No.: US 7,378,595 B2
(45) Date of Patent: May 27, 2008

(54) FULLY SAFELY OPERATING FIRE RESISTANT ELECTRIC CABLE

(75) Inventor: Angelo Brambilla, Milan (IT)

(73) Assignee: Controlacavi Industria S.r.l., Milan (IT)

( * ) Notice: Subject to any disclaimer, the term of this patent is extended or adjusted under 35 U.S.C. 154(b) by 0 days.

(21) Appl. No.: 11/595,263

(22) Filed: Nov. 10, 2006

(65) Prior Publication Data

US 2007/0144764 A1 Jun. 28, 2007

(30) Foreign Application Priority Data

Dec. 13, 2005 (IT) ..... MI2005A2378

(51) Int. Cl.
*H01B 7/00* (2006.01)

(52) U.S. Cl. ..... 174/113 R; 174/120 R; 174/120 C; 174/121 R; 174/121 A

(58) Field of Classification Search ..... 174/110 R, 174/113 R, 119 C, 120 R, 121 R, 121 A, 174/122 R, 122 G, 124 R, 124 G
See application file for complete search history.

(56) References Cited

U.S. PATENT DOCUMENTS

| | | | | | |
|---|---|---|---|---|---|
| 2,454,625 | A | * | 11/1948 | Bondon | 174/120 C |
| 2,800,524 | A | * | 7/1957 | Van Lear | 174/116 |
| 3,576,388 | A | * | 4/1971 | Bruns | 174/116 |
| 3,823,255 | A | * | 7/1974 | La Gase et al. | 174/113 R |
| 3,925,275 | A | * | 12/1975 | Musashi et al. | 525/278 |
| 4,395,459 | A | * | 7/1983 | Herschdorfer et al. | 428/391 |
| 4,605,818 | A | * | 8/1986 | Arroyo et al. | 174/107 |
| 5,079,077 | A | * | 1/1992 | Sakayanagi et al. | 442/212 |
| 5,891,553 | A | * | 4/1999 | Hendrix et al. | 428/209 |
| 2003/0114606 | A1 | * | 6/2003 | Taniguchi et al. | 525/523 |

* cited by examiner

*Primary Examiner*—William H Mayo, III
(74) *Attorney, Agent, or Firm*—James V. Costigan; Hedman & Costigan, P.C.

(57) ABSTRACT

A fire resistant electric cable having a plurality of electrically conductive wires, each having a layer having a glass fiber strip with a mica layer glued thereon, the mica layer being coated by at least a glass thread braid reinforcing layer.

5 Claims, 3 Drawing Sheets

FULLY SAFELY OPERATING FIRE RESISTANT ELECTRIC CABLE

BACKGROUND OF THE INVENTION

The present invention relates to a fully safely operating fire resistant electric cable.

As is known, fire or flame resistant electric cables must provide, as they are subjected to a direct flame and a consequent temperature variation from 750° C. to 930° C., a safe current flow for a time period from 1 to 2 hours.

Such temperature and flame exposition time variations will exclusively depend on different international standards, providing correspondingly different test methods.

Fire or flame resistant cables must be designed to assure a proper operation of the apparatus they are connected to, for limiting deleterious consequences of fire, and allowing lighting bodies and, in general, elements designed for assuring a quick evacuation of the fire affected regions to continuously operate at least for a set time period.

To solve the above mentioned problem, prior anti-fire electric cables conventionally comprise, on each individual copper conductor or wire thereof, a mica processed strip, i.e. a glass strip on a side of which a mica layer of a thickness of several microns is glued.

Thus, as the cable components are burnt away by the flame, which occurs in about 10-15 minutes, said thin mica layer will allow the cable to further operate even if for a very short time.

Thus, it should be apparent that the mica layer is the most critical part of the cable: actually a defective of said mica layer would cause electrical discharges and shorts thereby preventing the electric cable from further operating.

Another problem is that, in installing said cable it will be subjected to mechanical stresses susceptible to damage the mica layer and the cable insulating characteristics against outer agents.

In this connection it should be moreover pointed out that it is very difficult to provide a high strength, since, according to regulating standards, an electric cable may be considered as properly usable if, in testing operations, only a cable of three is discarded.

Accordingly, prior fire resistant electric cables have a poor fire performance, both due to a difficulty of properly applying the mica strip, and since said mica strip is quickly damaged by mechanical stress, thereby as the cable is installed it is so damaged that its waterproof properties are quickly loosen thereby generating electric shorts.

A prior approach to solve the above problem provides to use MICC cables including mineral insulation means which, however, are very expensive and require very difficult to be met installation condition, thereby they are only used in a very limited number of applications.

SUMMARY OF THE INVENTION

Accordingly, the aim of the present invention is to solve the above mentioned problem, by providing a fire resisting cable, having an optimum strength, both of a mechanical and thermal type, while allowing to preserve the above mentioned safe characteristics.

Within the scope of the above mentioned aim, a main object of the invention is to provide such an electric cable, which has a very safe operation and is free of expensive mineral coatings.

Another object of the present invention is to provide such an electric cable which is very reliable and safe in operation and which, moreover, very competitive from a mere economic standpoint.

Yet another object of the present invention is to provide such an electric cable which can be easily made and, moreover, is very safe and reliable.

According to one aspect of the present invention, the above mentioned aim and objects, as well as yet other objects, which will become more apparent hereinafter, are achieved by a fully safely operating fire resistant electric cable, comprising a plurality of electrically conductive wires, on each of which is applied a layer comprising a glass fiber strip, thereon a mica layer is glued, characterized in that said fire resistant electric cable comprises moreover a glass thread braid reinforcing said glass fiber and mica layer.

BRIEF DESCRIPTION OF THE DRAWINGS

Further characteristics and advantages of the present invention will become more apparent hereinafter from the following disclosure of a preferred, though not exclusive, embodiment of a fully safely operating fire resistant electric cable, which is illustrated, by way of an indicative, but not limitative example, in the accompanying drawings, where.

DESCRIPTION OF THE PREFERRED EMBODIMENT

Figure 1:
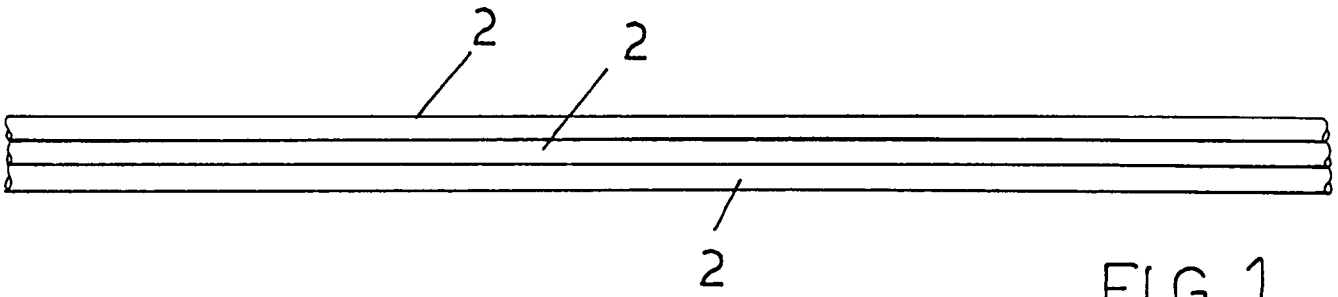
FIG. 1 is a schematic view showing the cable electric wires arranged adjoining one another.
Figure 2:
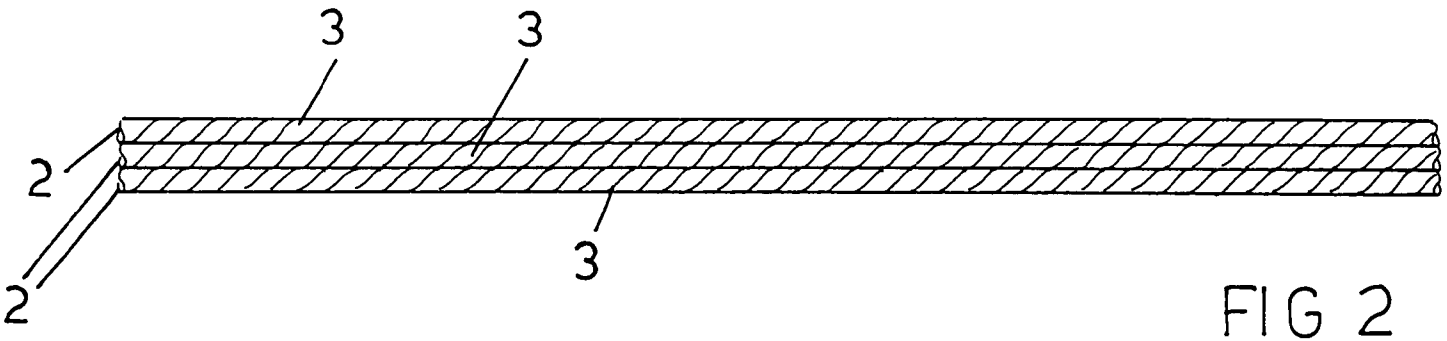
FIG. 2 shows the cable electric wires after having applied the glass fiber-mica strip thereto.
Figure 3:
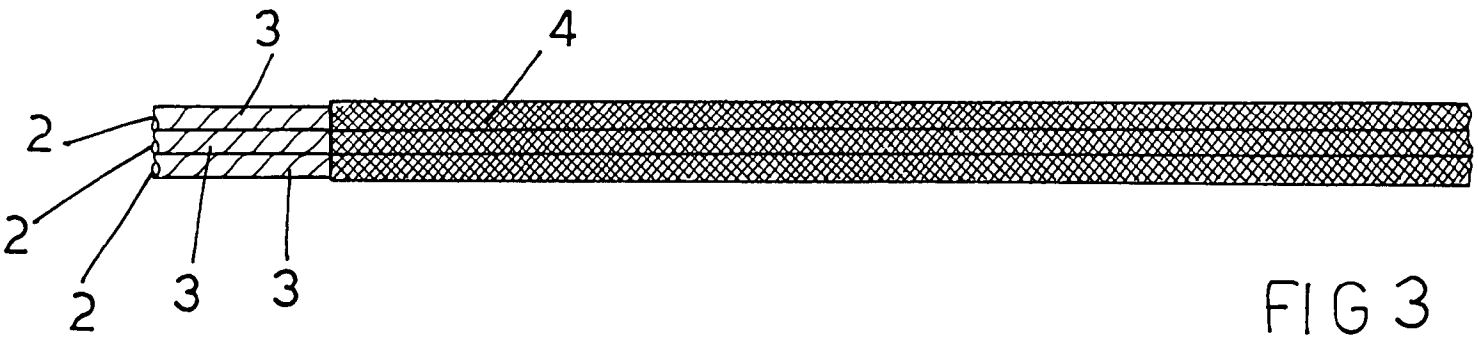
FIG. 3 shows the strip on which the reinforcement glass thread braid has been applied.
Figure 4:
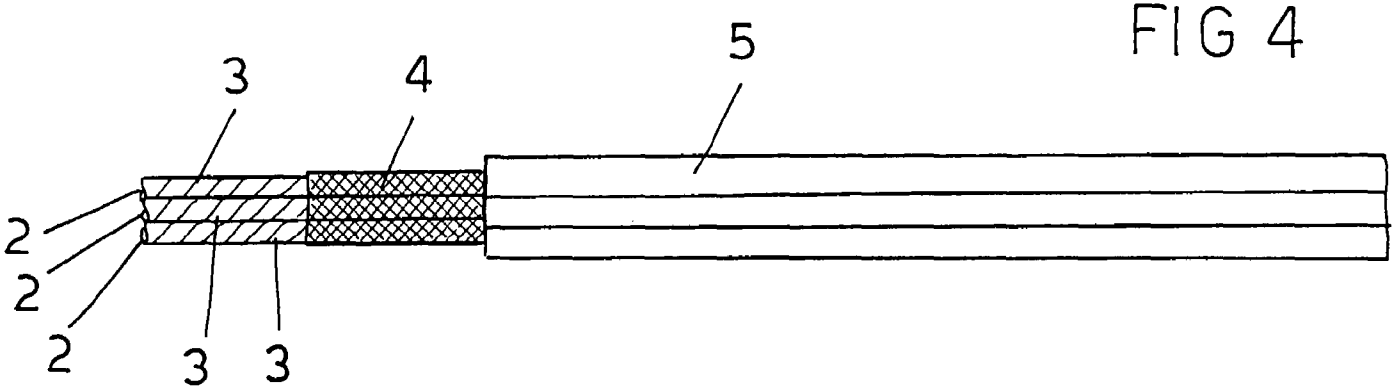
FIG. 4 shows the electric cable with the extruded insulating elastomeric layer.
Figure 5:
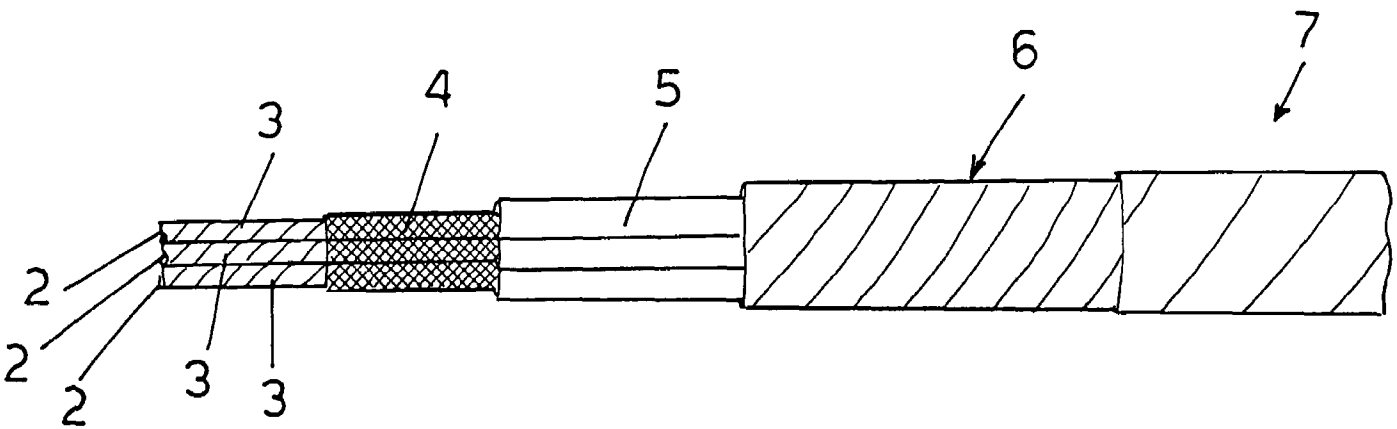
FIG. 5 shows the electric cable to which a copper strip and a glass fiber strip layer has been applied.
Figure 6:
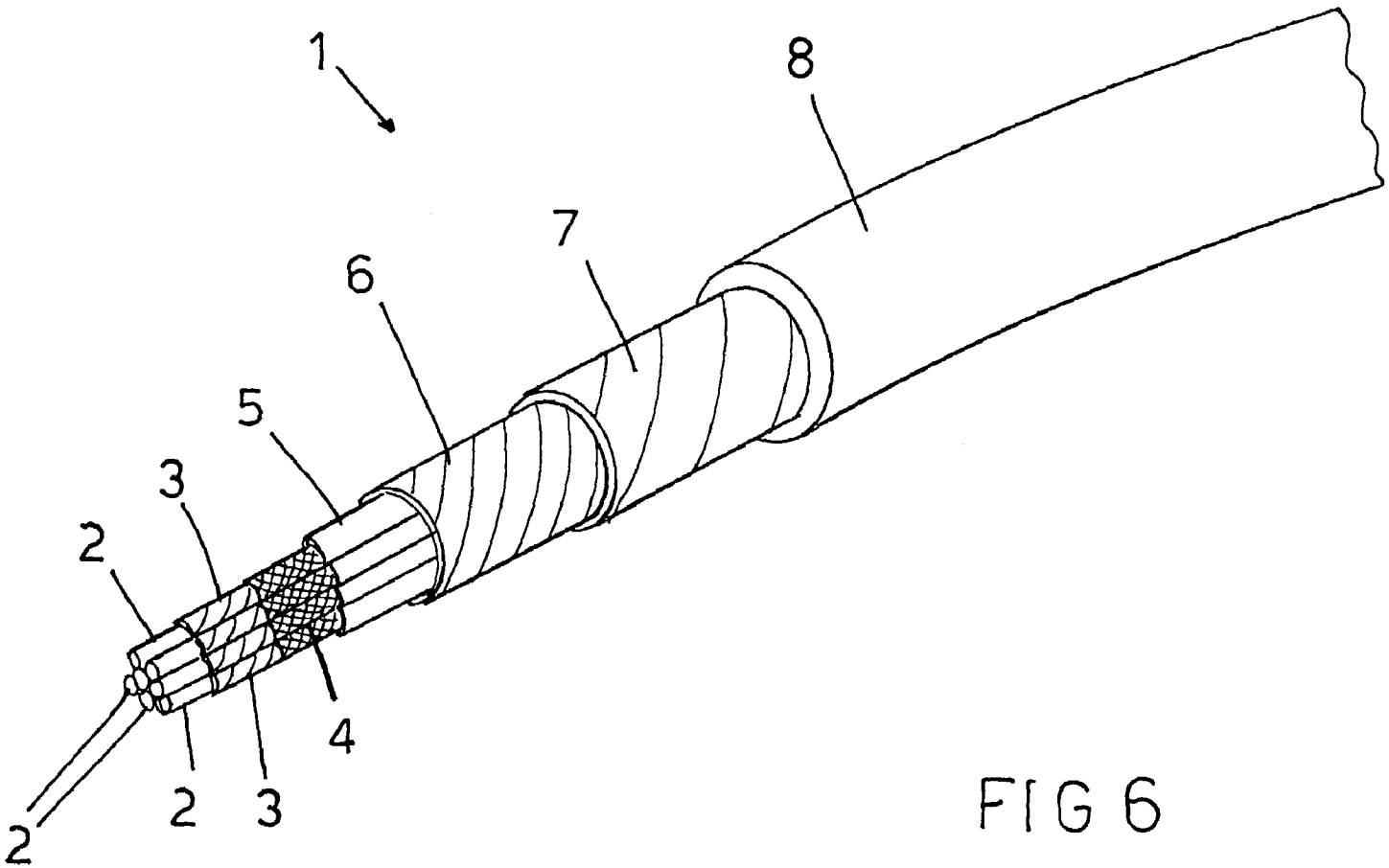
FIG. 6 shows a perspective view of the electric cable with an outer sheath layer applied thereto.

With reference to the number references of the above mentioned figures, the fully safely operating fire resistant electric cable according to the present invention, which has been generally indicated by the reference number 1, comprises a plurality of electrically conductive wires 2, which are typically made of a copper material.

Each individual wire is encompassed by a glass fiber strip 3 onto which a mica layer, having a thickness of few microns, as been glued.

Each individual mica stripped wire is passed through a suitable tester which, as it detects a minimum invisible defect in the applied strip switches off the cable making line to locate the defect and repair it.

This defect detection is a very important feature, since it will provide the cable being made with very high safe operation characteristics.

A further main and very important feature of the invention is that, for reinforcing the glass fiber and mica layer, a strong layer thread braid, impregnated by a polyurethane resin, is applied to the cable to provide the required mechanical strength to the cable.

Said reinforcing braid, which has been generally indicated by 4, is so made as to encompass each individual wire or, optionally, to encompassing a wire beam.

After having applied the reinforcing braid 4, an insulating elastomeric layer 5 is extruded thereon.

Then, a combined copper strip 6 and glass fiber strip 7 is further applied to provide the electric cable with very good waterproof and insulating properties, both in a flame and in a fire extinguishing condition.

More specifically, is herein used a glass thread strip, woven with a high beating density, and having a strip thickness from 0.15 to 0.50 mm.

Then, to said glass thread strip a copper layer having a width from 30 to 100 mm and a thickness from 20 to 50 microns is applied, said copper layer having a melting point of 1083° C. and providing the electric cable with the desired flexibility.

The copper strip, in combination with the glass strip, will provide a self-sealing effect, very useful in fires.

Moreover, the thus made cable will also resist against water, thereby preventing electric shorts from occurring.

For completing the above electric cable it is finally coated by an outer coating layer 8, having mechanical protective features, and made of atoxic thermoplastic materials or elastomeric coatings, providing the cable with further improved flexibility properties.

From the above disclosure it should be apparent that the invention fully achieves the intended aim and objects.

In particular, an electric cable has been provided which may safely operate even in a fire condition, owing to the provision of its reinforced mica layer.

Moreover, the cable further comprises an outer coating layer, which practically forms a waterproofing tubular element for waterproofing the cable individual electric wires.

The invention, as disclosed, is susceptible to several modifications and variations, all of which will come within the scope of the invention.

Moreover, all the details can be replaced by other technically equivalent elements.

In practicing the invention, the used materials, as well as the contingent size and shapes, can be any, depending on requirements.

The invention claimed is:

1. A fully safely operating fire resistant electric cable, said electric cable comprising a plurality of electrically conductive wires, wherein said electrically conductive wires are arranged adjoining with one another, each said electrically conductive wire comprising a copper wire coated by a first layer including a glass fiber strip, a second mica layer glued on said first layer, a third glass thread braid reinforcing layer applied on said second mica layer, said third layer being impregnated by a polyurethane resin providing said cable with a required mechanical strength, and being coated by a fourth extruded insulating elastomeric layer, said coated wires being further coated by a fifth layer made of a copper strip, said fifth layer being in turn covered by a sixth layer made of a glass strip, thereby as said electric cable is subjected to a direct flame with a consequent temperature variation from 750°C. to 930°C., said electric cable provides a safe continuous current flow for a time period from 1 to 2 hours.

2. An electric cable, according to claim 1, wherein said glass strip is made of a glass thread woven with a high beating density, and having a thickness from 0.15 to 0.50 mm.

3. An electric cable according to claim 1, wherein said copper strip has a thickness from 20 to 50 microns.

4. An electric cable according to claim 1, wherein said copper strip has a width from 30 to 100 mm.

5. An electric cable according to claim 1, wherein said sixth layer is coated by a seventh layer made of an atoxic thermoplastic material.

* * * * *